US007770237B1

(12) United States Patent
Wright et al.

(10) Patent No.: US 7,770,237 B1
(45) Date of Patent: Aug. 10, 2010

(54) BABY GARMENT FOR ACCESSING AND PROTECTING THE UMBILICAL CORD

(76) Inventors: Andre L. Wright, 4925 Brown Station Rd., Upper Marlboro, MD (US) 20772; Tracy L. Wright, 4925 Brown Station Rd., Upper Marlboro, MD (US) 20772

( * ) Notice: Subject to any disclaimer, the term of this patent is extended or adjusted under 35 U.S.C. 154(b) by 639 days.

(21) Appl. No.: 11/676,303

(22) Filed: Feb. 18, 2007

(51) Int. Cl.
*A41B 13/08* (2006.01)
*A41D 10/00* (2006.01)

(52) U.S. Cl. ..... 2/111; 2/114

(58) Field of Classification Search ..... 2/80, 2/111, 75, 114; 606/120; 604/385.09, 394
See application file for complete search history.

(56) References Cited

U.S. PATENT DOCUMENTS

| | | | | | |
|---|---|---|---|---|---|
| 1,998,051 | A * | 4/1935 | Gerber | 2/114 |
| 2,425,635 | A * | 8/1947 | Nitzberg | 2/75 |
| 2,735,103 | A * | 2/1956 | Saftlas | 2/80 |
| 3,568,213 | A * | 3/1971 | Mason | 2/80 |
| 4,144,593 | A * | 3/1979 | Timmons | 2/104 |
| 4,663,782 | A * | 5/1987 | Knox et al. | 2/104 |
| 4,688,270 | A * | 8/1987 | Denicola et al. | 2/102 |
| 5,048,122 | A * | 9/1991 | Prieur | 2/69 |
| 5,048,512 | A * | 9/1991 | Turner et al. | 128/876 |
| 5,093,932 | A * | 3/1992 | Doyle | 2/114 |
| 5,806,096 | A * | 9/1998 | Pennington | 2/80 |
| 6,327,712 | B1 * | 12/2001 | Armstrong et al. | 2/104 |
| 6,438,758 | B1 * | 8/2002 | Burkard et al. | 2/115 |
| 6,668,382 | B1 * | 12/2003 | Wright | 2/75 |
| D491,340 | S * | 6/2004 | Gorman | D2/728 |
| 7,181,773 | B1 * | 2/2007 | Piraka | 2/114 |
| 7,530,118 | B2 * | 5/2009 | Osborne et al. | 2/69.5 |
| 2006/0031976 | A1 * | 2/2006 | Nwawka | 2/114 |
| 2006/0212013 | A1 * | 9/2006 | Cohen et al. | 604/385.09 |
| 2006/0241558 | A1 * | 10/2006 | Ramshak | 604/385.09 |
| 2006/0253953 | A1 * | 11/2006 | Williams | 2/69 |
| 2007/0130668 | A1 * | 6/2007 | Berman et al. | 2/114 |
| 2008/0115253 | A1 * | 5/2008 | Gorman | 2/84 |
| 2008/0115255 | A1 * | 5/2008 | Gorman | 2/114 |
| 2009/0031471 | A1 * | 2/2009 | Dague | 2/83 |
| 2009/0099632 | A1 * | 4/2009 | Krier | 607/108 |

* cited by examiner

*Primary Examiner*—Alissa L Hoey
(74) *Attorney, Agent, or Firm*—David A. Lingbeck

(57) ABSTRACT

A baby garment for accessing and protecting the umbilical cord for allowing the cleaning of and protecting a baby's umbilical cord. The baby garment for accessing and protecting the umbilical cord includes includes a piece of material having front and back portions and also having an umbilical-exposing hole being disposed through the front portion and about the baby's umbilical cord to allow a user to effectively clean the umbilical cord without the user having to remove the baby garment from the baby, and an oversized cover being hingedly attached to the front portion and being fastenably closeable and loosely disposed over the umbilical cord to effectively protect and not to irritate the umbilical cord.

4 Claims, 2 Drawing Sheets

BABY GARMENT FOR ACCESSING AND PROTECTING THE UMBILICAL CORD

BACKGROUND OF THE INVENTION

1. Field of the Invention

The present invention relates to baby garments and more particularly pertains to a new baby garment for accessing and protecting the umbilical cord for allowing the cleaning of and protecting a baby's umbilical cord.

2. Description of the Prior Art

The user of baby garments is known in the prior art. More specifically, baby garments heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned parents do not disclose a new baby garment for accessing and protecting the umbilical cord. The prior arts include the traditional baby garments such as one-piece outfits or top and bottom pieces. None of the prior arts include baby garments which specifically have an umbilical-exposing hole and an oversized cover which protects the umbilical cord without rubbing against it or irritating it.

SUMMARY OF THE INVENTION

The general purpose of the present invention, which will be described subsequently in greater detail, is to provide a new baby garment for accessing and protecting the umbilical cord which has many of the advantages of the baby garments mentioned heretofore and many novel features that result in a new baby garment for accessing and protecting the umbilical cord which is not anticipated, rendered obvious, suggested, or even implied by any of the prior art baby garments, either alone or in any combination thereof. The present invention includes a piece of material having front and back portions and also having an umbilical-exposing hole being disposed through the front portion and about the baby's umbilical cord to allow a user to effectively clean the umbilical cord without the user having to remove the baby garment from the baby, and an oversized cover being hingedly attached to the front portion and being fastenably closeable and loosely disposed over the umbilical cord to effectively protect and not to irritate the umbilical cord. None of the prior art includes the combination of the elements of the present invention.

There has thus been outlined, rather broadly, the more important features of the baby garment for accessing and protecting the umbilical cord in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new baby garment for accessing and protecting the umbilical cord which has many of the advantages of the baby garments mentioned heretofore and many novel features that result in a new baby garment for accessing and protecting the umbilical cord which is not anticipated, rendered obvious, suggested, or even implied by any of the prior art baby garments, either alone or in any combination thereof.

Still another object of the present invention is to provide a new baby garment for accessing and protecting the umbilical cord for allowing the cleaning of and protecting a baby's umbilical cord.

Still yet another object of the present invention is to provide a new baby garment for accessing and protecting the umbilical cord that allows the user to carefully cover and protect the umbilical cord without irritating it.

Even still another object of the present invention is to provide a new baby garment for accessing and protecting the umbilical cord that easily exposes the umbilical cord for easy cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
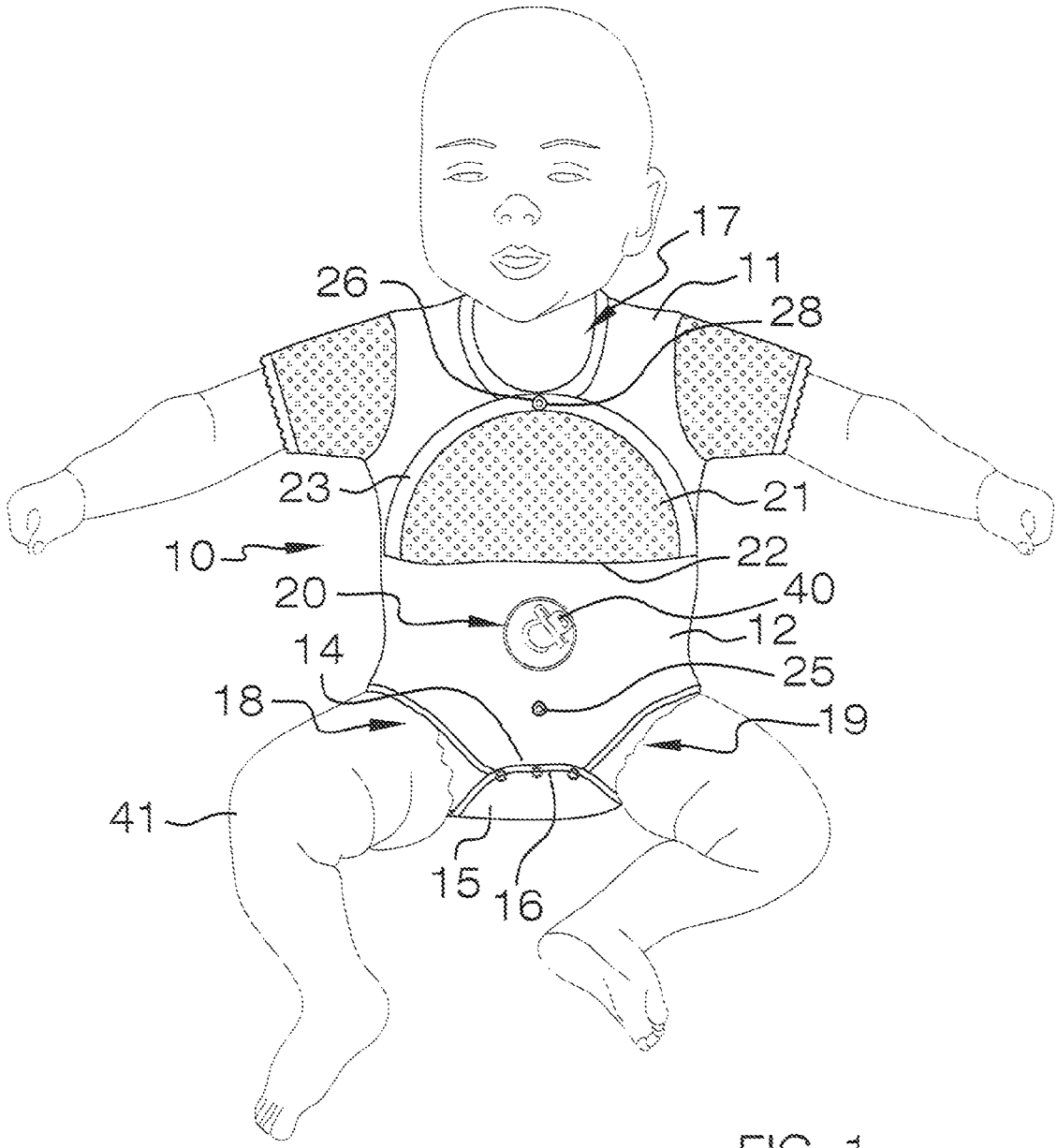
FIG. 1 is a front elevational view of a new baby garment for accessing and protecting the umbilical cord according to the present invention with the oversized cover being fastened in an open position to expose the umbilical cord.
Figure 2:
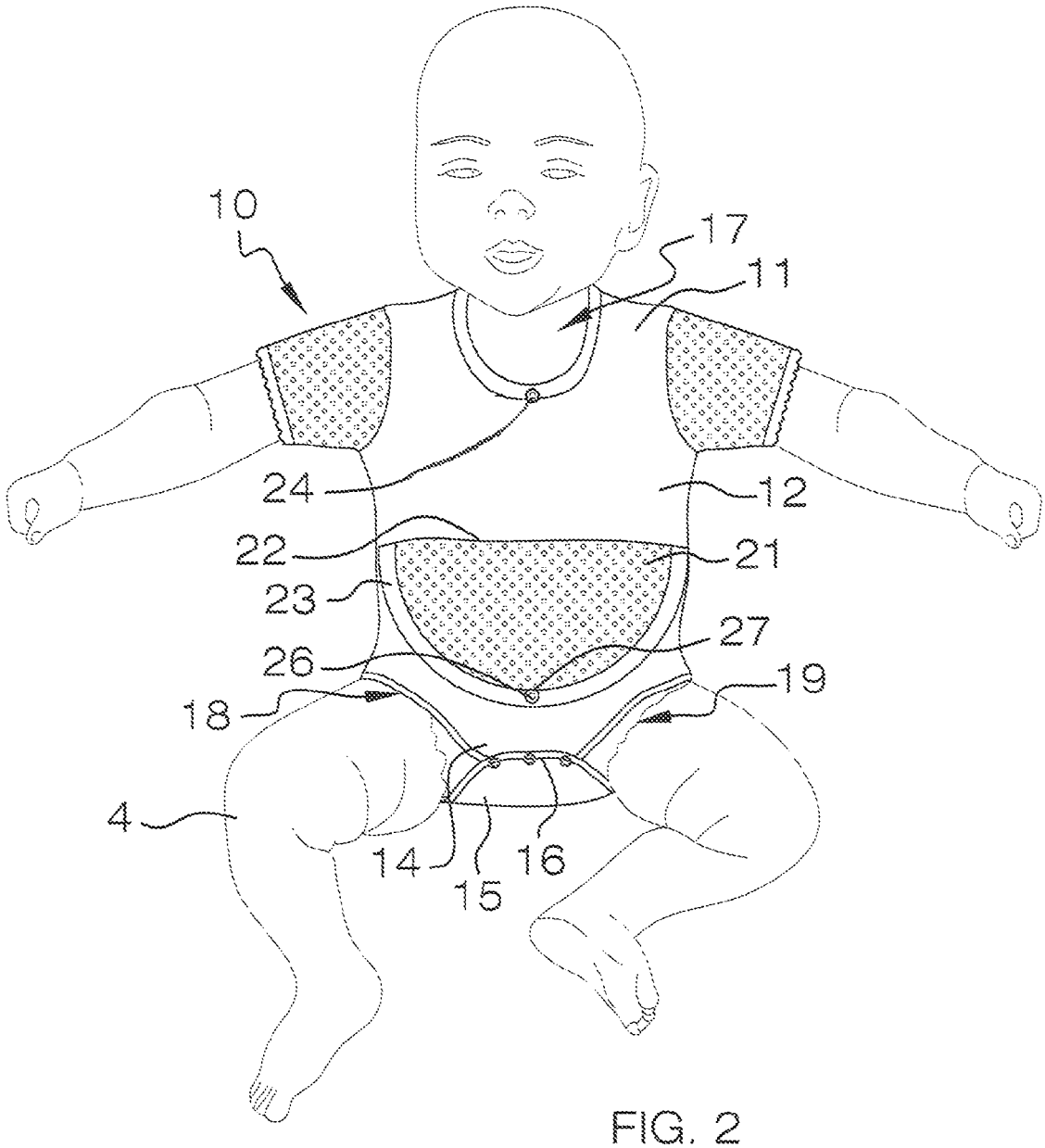
FIG. 2 is a front elevational view of a new baby garment for accessing and protecting the umbilical cord according to the present invention with the oversized cover being fastened in a closed position over the umbilical cord.

With reference now to the drawings, and in particular to FIGS. 1 through 2 thereof, a new baby garment for accessing and protecting the umbilical cord embodying the principles and concepts of the present invention and generally designated by the reference numeral 10 will be described.

As best Illustrated in FIGS. 1 through 2, the baby garment for accessing and protecting the umbilical cord 10 generally comprises a piece of material 11 having front and back portions 12,15 and also having an umbilical-exposing hole 20 being disposed through the front portion 12 and about the baby's umbilical cord 40 to allow a user to effectively clean the umbilical cord 40 without the user having to remove the baby garment 10 from the baby 41. The piece of material 11 further includes a neck-receiving opening 17. The front and back portions 12,15 have bottom edges 14,16 which are conventionally fastenable to one another to form leg-receiving openings 18,19.

An oversized cover 21 is hingedly attached and sewn to the front portion 12 and is fastenably closeable and loosely disposed over the umbilical cord 40 to effectively protect and not to irritate the umbilical cord 40. The oversized cover 21 has a hinged edge 22 which is securely attached and sewn to and extends across an entire width of the front portion 12 with the hinged edge 22 effectively bisecting the front portion 12. The oversized cover 21 also has a width which is substantially equivalent to the width of the front portion 12 and extends entirely from a left side 42 to a right side 43 of the piece of material 11. The oversized cover 21 further has a length which extends from where the hinged edge 22 effectively bisects the front portion 12 to the neck-receiving opening 17 when the oversized cover 21 is in the opened position to expose the umbilical cord 40. The oversized cover 21 also has a length which extends from where the hinged edge 22 effectively bisects the front portion 12 to a position substantially halfway between the umbilical-exposing hole 20 and the bottom edge 14 of the front portion 12 such that the oversized cover 20 is loosely disposed over the umbilical cord 40 so as not to rub and irritate the umbilical cord 40. The umbilical-exposing hole 20 is larger than the umbilical cord 40 and does not engage any part of the umbilical cord 40 so as not to irritate or rub the umbilical cord 40. The oversized cover 21 is approximately 5 times larger than that of the umbilical-exposing hole 20 so that the oversized cover 21 is loosely disposed over the umbilical cord 40 without rubbing and irritating the umbilical cord 40. The oversized cover 21 also has an arcuate outer edge 23.

The baby garment 10 for accessing and protecting the umbilical cord further includes first and second male fasteners 24,25 being conventionally attached to the front portion 12, and also includes a dual female fastener 26 being conventionally attached to the oversized cover 21. The first male fastener 24 is conventionally attached at an edge of the neck-receiving opening 17, and the second male fastener 25 is conventionally attached halfway between the umbilical-exposing hole 20 and the bottom edge 14 of the front portion 12. The dual female fastener 26 is centrally and conventionally attached at the arcuate outer edge 23 of the oversized cover 21 and has a front side 27 and a back side 28 with the front side 27 being fastened to the first male fastener 24 when the oversized cover 21 is in the open position to expose the umbilical cord 40 and with the back side 28 being fastened to the second male fastener 25 when the oversized cover 21 is closed over the umbilical cord 40.

In use, the user slips the baby garment 10 over the baby 41 and conventionally fastens the bottom edges 14,16 of the front and back portions 12,15 together with umbilical-exposing hole 20 being centered about the umbilical cord 40. To protect the umbilical cord 40, the oversized cover 21 is loosely disposed over the umbilical cord 40 with the back side 28 of the dual female fastener 26 being fastened to the second male fastener 25. The oversized cover 21 provides enough slack so as not to rub or irritate the umbilical cord 40, but yet protects the umbilical cord 40 from the elements of the environment. To clean the umbilical cord 40, the user unfastens the oversized cover 21 from the second male fastener 25 and lifts and fastens the front side 27 of the dual female fastener 26 to the first male fastener 24. Once finished, the oversized cover 21 is refastened over the umbilical cord 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the baby garment for accessing and protecting the umbilical cord. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A baby garment for accessing and protecting the umbilical cord comprising:

a piece of material having front and back portions and also having an umbilical-exposing hole being disposed through said front portion and about the baby's umbilical cord to allow a user to effectively clean the umbilical cord without the user having to remove the baby garment from the baby, said piece of material further including a neck-receiving opening; and an oversized cover being hingedly attached to said front portion and being fastenably closeable and loosely disposed over the umbilical cord to effectively protect and not to irritate the umbilical cord, said oversized cover having a hinged edge which is securely attached to and extends laterally across an entire width of said front portion, said hinged edge effectively bisecting said front portion, said front and back portions having bottom edges which are fastenable to one another to form leg-receiving openings, said oversized cover also having a width which is substantially equivalent to the width of said front portion and extends entirely from a left side to a right side of said piece of material, said oversized cover having a length which extends from where said hinged edge effectively bisects said front portion to a position substantially halfway between said umbilical-exposing hole and said bottom edge of said front portion such that said oversized cover is loosely and bulgingly disposed over said umbilical cord and does not rub nor irritate the umbilical cord.

2. A baby garment for accessing and protecting the umbilical cord comprising:

a piece of material having front and back portions and also having an umbilical-exposing hole being disposed through said front portion and about the baby's umbilical cord to allow a user to effectively clean the umbilical cord without the user having to remove the baby garment from the baby, said piece of material further including a neck-receiving opening;

an oversized cover being hingedly attached to said front portion and being fastenably closeable and loosely disposed over the umbilical cord to effectively protect and not to irritate the umbilical cord, said hinged edge effectively bisecting said front portion, said front and back portions having bottom edges which are fastenable to one another to form leg-receiving openings, said oversized cover also having a width which is substantially equivalent to the width of said front portion and extends entirely from a left side to a right side of said piece of material, said oversized cover also having an arcuate outer edge; and first and second male fasteners being attached to said front portion, and also including a dual female fastener being attached to said oversized cover.

3. The baby garment for accessing and protecting the umbilical cord as described in claim 2, wherein said first male fastener is attached at a bottom edge of said neck-receiving opening, and said second male fastener is attached halfway between said hole and said bottom edge of said front portion.

4. The baby garment for accessing and protecting the umbilical cord as described in claim 3, wherein said dual female fastener is centrally attached at said arcuate outer edge of said oversized cover and has a front side and a back side with said front side being fastened to said first male fastener when said oversized cover is in the open position to expose the umbilical cord and with said back side being fastened to said second male fastener when said oversized cover is closed over said umbilical cord.

* * * * *